United States Patent [19]

Pisio et al.

[11] 4,019,575

[45] Apr. 26, 1977

[54] SYSTEM FOR RECOVERING VISCOUS PETROLEUM FROM THICK TAR SAND

[75] Inventors: Peter Pisio; Charles F. Kirkvold, both of Calgary, Canada

[73] Assignee: Chevron Research Company, San Francisco, Calif.

[22] Filed: Dec. 22, 1975

[21] Appl. No.: 643,579

[52] U.S. Cl. ..... 166/61; 166/302

[51] Int. Cl.[2] ..... E21B 43/24

[58] Field of Search ..... 166/57, 61, 272, 302, 166/303, 314

[56] References Cited

UNITED STATES PATENTS

| | | | |
|---|---|---|---|
| 1,012,777 | 12/1911 | Wigle | 166/61 |
| 2,911,047 | 11/1959 | Henderson | 166/61 |
| 3,338,306 | 8/1967 | Cook | 166/302 |
| 3,412,794 | 11/1968 | Craighead | 166/272 |
| 3,420,302 | 1/1969 | Edwards | 166/61 |
| 3,493,050 | 2/1970 | Kelley et al. | 166/302 |
| 3,608,638 | 9/1971 | Terwilliger | 166/272 |
| 3,796,265 | 3/1974 | Eickmeier | 166/303 |
| 3,908,763 | 9/1975 | Chapman | 166/302 |

*Primary Examiner*—Ernest R. Purser

*Attorney, Agent, or Firm*—E. J. Keeling; R. L. Freeland, Jr.

[57] ABSTRACT

Recovery of viscous petroleum such as from thick tar sands is assisted using a closed-loop flow path formed in a well by concentric casing and tubular members extending from the earth's surface through a substantial portion of the formation for conducting hot fluid to reduce the viscosity of the petroleum in the formation to develop a potential passage in the formation outside the flow path into which a drive fluid is injected to promote movement of the petroleum to the well for production up a production flow line extending up the interior of the tubular member.

3 Claims, 5 Drawing Figures

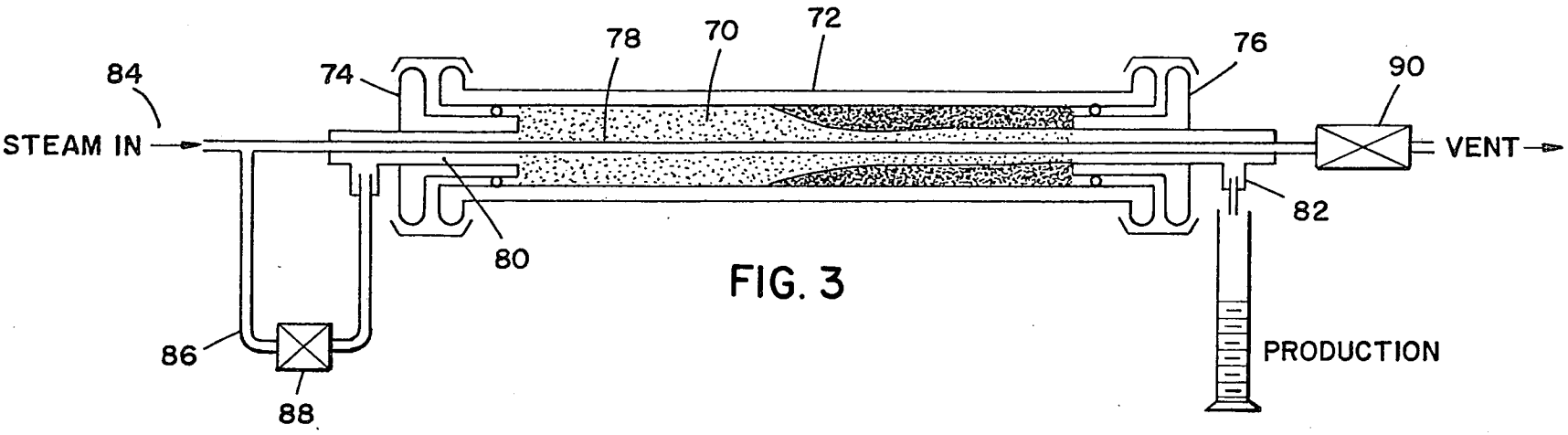
FIG. 3
RESIDUAL PETROLEUM WT %
| CORE POSITION | | PLANE A | B | C | D | E | F |
|---|---|---|---|---|---|---|---|
| LEFT SIDE | 1 | 3.8 | 5.5 | 5.9 | 6.5 | 8.2 | 7.2 |
| | 2 | 3.7 | 4.4 | 5.4 | 4.3 | 7.3 | 5.7 |
| | 3 | 3.9 | 4.2 | 5.2 | 5.7 | 4.6 | 7.9 |
| CENTER LINE | 4 | 3.7 | 4.4 | 5.2 | 4.9 | 8.8 | 9.0 |
| | 5 | 3.7 | 4.8 | 3.7 | 4.3 | 7.3 | 7.1 |
| | 6 | 3.7 | 3.9 | 4.1 | 4.2 | 6.7 | 5.4 |
| | 7 | 3.8 | 4.7 | 4.0 | 5.0 | 4.5 | 4.9 |
| RIGHT SIDE | 8 | 4.2 | 5.2 | 6.0 | 6.4 | 10.9 | 9.5 |
| | 9 | 3.8 | 4.4 | 5.8 | 4.5 | 7.0 | 7.3 |
| | 10 | 3.9 | 4.2 | 5.8 | 4.3 | 6.0 | 6.2 |
| | 11 | 4.1 | 5.1 | 7.1 | 5.4 | 5.2 | 5.8 |
FIG. 5
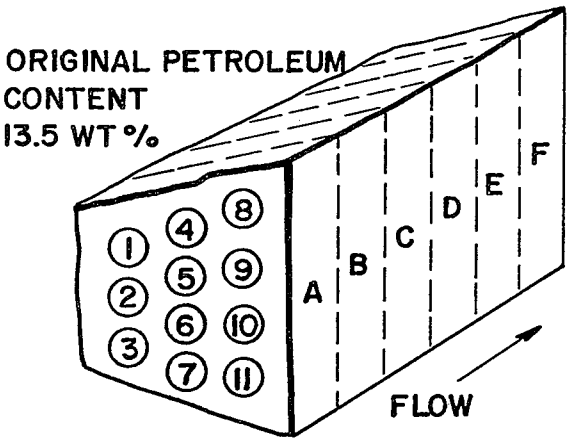
FIG. 4

SYSTEM FOR RECOVERING VISCOUS PETROLEUM FROM THICK TAR SAND

CROSS REFERENCE TO RELATED APPLICATIONS

This application is related to application Ser. No. 627,304, filed Oct. 30, 1975, for "Method of Recovering Viscous Petroleum from an Underground Formation", application Ser. No. 627,305, filed Oct. 30, 1975, for "Method of Recovering Viscous Petroleum from Tar Sand", application Ser. No. 627,306, filed Oct. 30, 1975, for "Recovering Viscous Petroleum from Thick Tar Sand", application Ser. No. 643,580, filed Dec. 22, 1975, for "Method of Recovering Viscous Petroleum from Thick Tar Sand" and application Ser. No. 650,571, filed Jan. 19, 1976, for "Arrangement for Recovering Viscous Petroleum from Thick Tar Sand."

BACKGROUND OF THE INVENTION

This invention relates generally to recovering viscous petroleum from petroleum-containing formations. Throughout the world there are several major deposits of high-viscosity crude petroleum in oil sands not recoverable in their natural state through a well by ordinary production methods. In the United States, the major concentration of such deposits is in Utah, where approximately 26 billion barrels of in-place heavy oil or tar exists. In California, the estimate of in-place heavy oil or viscous crude is 220 million barrels. By far the largest deposits in the world are in the Province of Alberta, Canada, and represent a total in-place resource of almost 1000 billion barrels. The depths range from surface outcroppings to about 2000 ft.

To date, none of these deposits has been produced commercially by an in-situ technology. Only one commercial mining operation exists, and that is in a shallow Athabasca deposit. A second mining project is about 20% completed at the present time. However, there have been many in-situ well-to-well pilots, all of which used some form of thermal recovery after establishing communication between injector and producer. Normally such communication has been established by introducing a pancake fracture. The displacing or drive mechanism has been steam and combustion, such as the project at Gregoire Lake or steam and chemicals such as the early work on Lease 13 of the Athabasca deposit. Another means of developing communication is that proposed for the Peace River project. It is expected to develop well-to-well communication by injecting steam over a period of several years into an acquifer underlying the tar sand deposit at a depth of around 1800 ft. Probably the most active insitu pilot in the oil sands has been that at Cold Lake. This project uses the huff-and-puff single-well method of steam stimulation and has been producing about 4000 barrels of viscous petroleum per day for several years from about 50 wells. This is probably a semi-commercial process, but whether it is a paying proposition is unknown.

The most difficult problem in any in-situ well-to-well viscous petroleum project is establishing and maintaining communication between injector and producer. In shallow deposits, fracturing to the surface has occurred in a number of pilots so that satisfactory drive pressure could not be maintained. In many cases, problems arise from healing of the fracture when the viscous petroleum that had been mobilized through heat cooled as it moved toward the producer. The cool petroleum is essentially immobile, since its viscosity in the Athabasca deposits, for example, is on the order of 100,000 to 1,000,000 cp at reservoir temperature.

As noted, the major problem of the economic recovery from many formations has been establishing and maintaining communication between an injection position and a recovery position in the viscous oil-containing formation. This is primarily due to the character of the formations, where effective mobility of fluids may be extremely low, and in some cases, such as the Athabasca Tar Sands, virtually nil. Thus, the Athabasca Tar Sands, for example, are strip mined where the overburden is limited. In some tar sands, hydraulically fracturing has been used to establish communication between injectors and producers. This has not met with uniform success. A particularly difficult situation develops in the intermediate overburden depths, which cannot stand fracturing pressure.

Heretofore, many processes have been utilized in attempting to recover viscous petroleum from viscous oil formations of the Athabasca Tar Sands type. The application of heat to such viscous petroleum formations by steam or underground combustion has been attempted. The use of slotted liners positioned in the viscous oil formation as a conduit for hot fluids has also been suggested. However, these methods have not been overly successful because of the difficulty of establishing and maintaining communication between the injector and the producer. Clearly, if one could establish and maintain communication between injector and producer, regardless of the drive fluid or recovery technique employed, it would open up many of these viscous petroleum deposits to a number of potentially successful projects.

BRIEF DESCRIPTION OF THE INVENTION

The present invention is directed to a system for assisting the recovery of viscous petroleum from a petroleum-containing formation and is particularly useful in those formations where communication between an injection position and a recovery position is difficult to establish and maintain. The system in accordance with the present invention of assisting the recovery of viscous petroleum from a petroleum-containing formation is particularly useful in a formation having a large vertical dimension. A substantially vertical well is formed through the tar sand-containing formation. A casing string having a production opening near its lower portion is inserted into the well. A production flow line is extended from a position adjacent the production opening of the casing to the earth's surface and the space between the interior of the casing string and the exterior of the production flow line is packed off. A tubular member is extended into the well between the interior of the casing string and the exterior of the production flow line from the earth's surface to a position above the packoff means to form a closed-loop flow path from the earth's surface to the packoff means and back to the earth's surface. A hot fluid is circulated through the closed-loop flow path to heat the viscous petroleum in the formation adjacent at least a portion of the well to form a potential passageway for fluid flow through the formation, and a drive fluid is injected into the upper portion of the formation near the potential passageway to promote flow of petroleum to the production opening near the bottom of the casing string of the well. In preferred form, the hot fluid which is flowed through the flow path is steam, and the drive fluid used to promote movement of the petroleum is also steam. In some situations, other fluids such as gas or water may be useful drive fluids. Depending on certain conditions, the hot fluid and the drive fluid are injected simultaneously. Under other conditions, the hot fluid and the drive fluid are injected intermittently or alternately. The injectivity of the drive fluid into the formation is controlled to some extent by adjusting the flow of hot fluid through the closed-loop flow path. In this manner, the sweep efficiency of the drive fluid in the formation may be improved.

OBJECT OF THE INVENTION

The principal object of the present invention is to maximize recovery of viscous petroleum from a tar sand having a large vertical dimension wherein communication between an injector position and a producer position is difficult to establish and maintain by utilizing a hot fluid in a physically separated, substantially vertical flow path through the formation to assist in establishing and maintaining communication for a drive fluid used to promote movement of the petroleum to the producer position. Further objects and advantages of the present invention will become apparent when the description is read in view of the accompanying drawings which are made a part of this specification.

BRIEF DESCRIPTION OF THE DRAWINGS

FIG. 3 is an elevation view partially in section and illustrates apparatus used in conducting demonstrations in accordance with the present invention;

FIG. 4 is a perspective view of a block of tar sand flooded in accordance with the present invention showing position of core samples taken after the flood; and FIG. 5 is a table illustrating the analysis of such cores.

DETAILED DESCRIPTION OF THE EMBODIMENTS OF THE INVENTION

Figure 1:
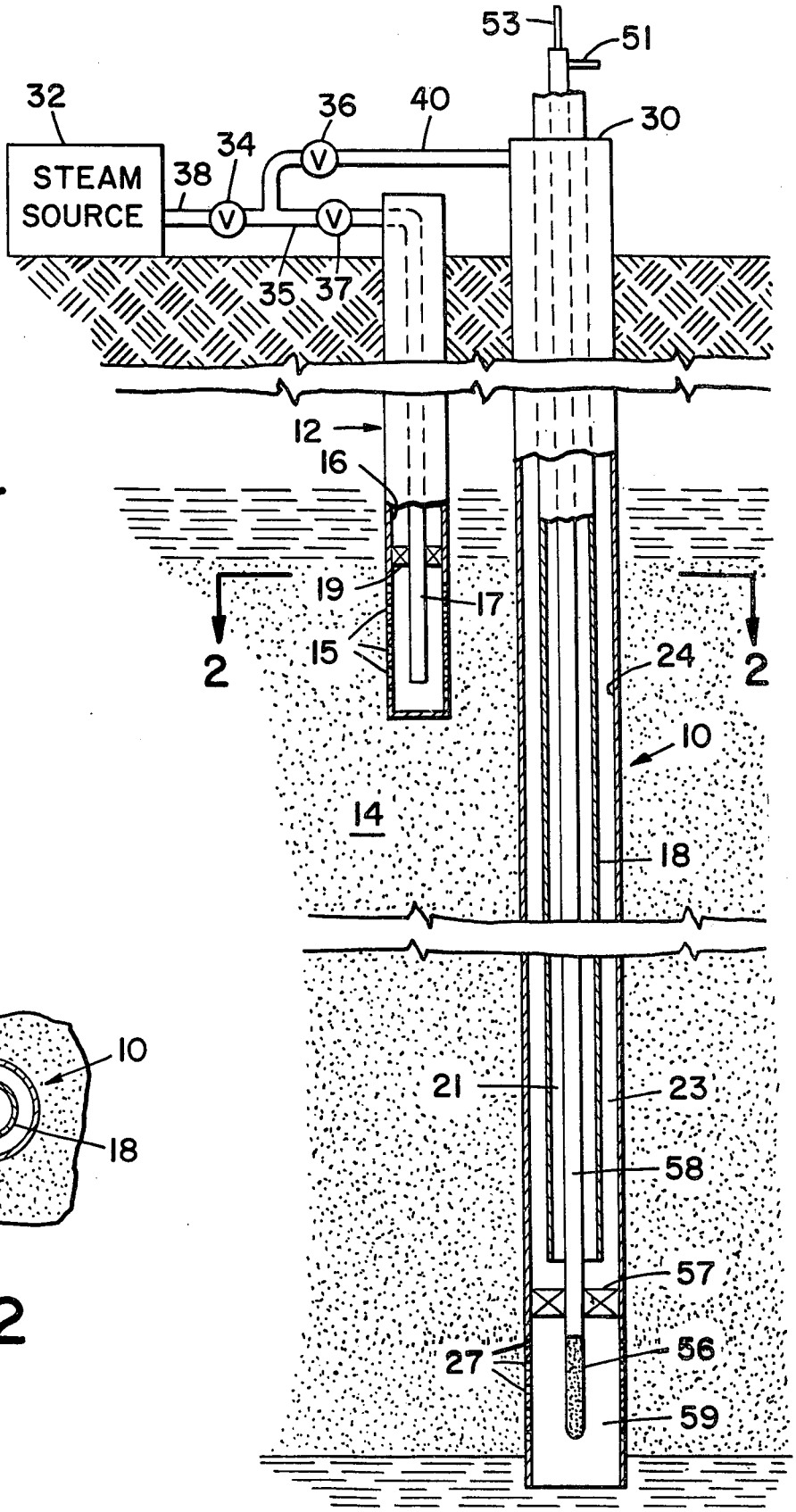
FIG. 1 is an elevation view partially in section and illustrates the preferred embodiment of apparatus assembled in accordance with the present invention for use in recovering viscous petroleum from an underground formation.

Refer now to the drawings, and to FIG. 1 in particular, where the preferred embodiment of apparatus assembled in accordance with the invention is illustrated. FIG. 1 shows a substantially vertical passage formed through a petroleum-containing tar sand 14. The vertical passage may be a well, as generally indicated by the number 10, and is cased by means of casing 24. A wellhead 30 is located at the upper end of the casing 24. A hollow tubular member 18 extends through the wellhead 30 to a position near the lower part of the tar sand 14.

A suitable pump 56 is connected to the surface by a production flow line 58 located interiorly of the hollow tubular member 18. A packoff means packs off the flow line 58 and the interior of the casing 24 to flow outside the flow line above the pump and below the end of the tubular member 18. Thus, a production position 59 is formed below the packoff means 57. A number of perforations 27 are provided in the casing to permit flow of fluids from the formation into the production position. The casing 24, the tubular member 18 and the production flow line 58 cooperate to form a pair of concentric annular flow paths 21 and 23 extending from the surface down the well to a portion above packoff means 57 and then back up the well to the surface. Thus a closed-loop flow path is formed through at least a portion of the tar sand for flow of fluid therethrough out of direct contact with the tar sand. A production flow line is positioned interiorly of the flow path.

A source of hot fluid such as a steam source 32 is connected to the annular flow path 23 between the casing 24 and the outside of the tubular member 18 by means of conduits 38 and 40 through valves 34 and 36. Steam is flowed down the annular flow path 23 out of direct contact with the tar sand to a position near the lower portion thereof and above packoff means 57. The steam and/or condensate then flows up the well through the portion of the closed-loop flow path formed by the annular flow path 21 between the interior of the tubular member 18 and the exterior of the production flow line 58. Produced fluids are pumped up the interior of the flow path through production line 58 and out production tap 51 by means of sucker rod string 53.

At least one spaced-apart well generally indicated by the numeral 12 penetrates at least the upper portion of the tar sand formation 14. The well is cased by casing 16 which has slots or perforations 15 formed adjacent the tar sand. An injection line 17 extends through packoff means 19 to a position near the perforations. A steam source 32 is connected by lines 38 and 35 through valves 34 and 37 to the injection line 17. Thus, steam may be injected into the formation 14 through well 12.

In operation, it is usually desirable to first introduce steam into the well 12 to attempt to obtain injection of steam into formation 14 through perforations 15. In most instances, in viscous tar sands little or no injection is obtained. In accordance with the invention, steam is then flowed through the closed-loop flow path via flow annulus 23 to heat the viscous petroleum in tar sand formation 14 to reduce the viscosity of at least a portion of the petroleum adjacent the casing 24. This provides a potential passage for flow of the drive fluid or steam from well 12 into the formation via perforations 15. By suitably controlling the flow in the closed-loop flow path and the formation 14, a good sweep efficiency can be obtained and oil recovery maximized through perforations 27 into recovery position 59. Thus, when the steam flowing in the flow path establishes injectivity for the drive fluid into the formation and results in some production of petroleum from the producer well 10, steam flow through the closed-loop flow path in well 10 is terminated to prevent breakthrough of the drive fluid. If the injectivity of the drive fluid becomes undesirably low, then additional steam is flowed through the closed-loop flow path to reestablish the desired injectivity.

Figure 2:
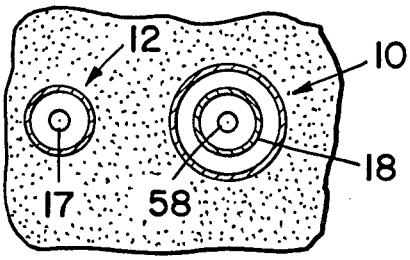
FIG. 2 is a sectional view taken at 2—2 of FIG. 1.

FIG. 2 is a sectional view taken at line 2—2 of FIG. 1. Wells 12 and 10 are shown in relatively closely spaced-apart relationship. In operation, it may be desirable to have a plurality of steam injection wells 12 spaced around the producing well 10. Generally, 4 spaced-apart injectors are preferred.

FIG. 3 is an elevation view partially in section and illustrates apparatus used in conducting demonstrations in accordance with the present invention. As there shown, a sand pack 70 of Athabasca tar sand was encased in a suitable elongated core tube 72. The core tube was provided with suitable end plates 74 and 76 for receiving a hollow tubular member 78. The apparatus is also arranged for steam injection into the face of the sand pack through conduit 80 and for collecting proceeds of the sand pack flood through conduit 82. A steam source 84 is connected to the tubular member 78 and to the sand pack face through tubing 86 and control valve 88. A down-stream control valve 90 controls flow of steam through the central tubular member 78. Thus, assisted recovery operations in accordance with the invention can be demonstrated utilizing the apparatus shown in FIG. 3.

FIG. 4 is a perspective of a block of Athabasca tar sand showing a number of core positions for cores taken longitudinally through the core block. The cores are identified by number and flow plane as indicated. The tar sand block was flooded in accordance with the method of the invention. The cores were taken after the flood and analyzed for residual petroleum. FIG. 5 is a table indicating the residual viscous petroleum weight by core position and plane of the cores of FIG. 4. The original block contained 13.5% by weight of viscous petroleum. As is evident from the table of FIG. 5, a substantial weight percent of a viscous petroleum was recovered when the block was flooded in accordance with the method of the present invention.

Further with respect to FIGS. 3, 4 and 5, in order to demonstrate the method of the present invention, it was necessary as a first step to set up an apparatus containing Athabasca oil sand having a zero effective permeability to steam. To do this, a 1 inch-ID by 12 inch-long quartz tube was used. The tube was packed with Athabasca oil sand containing about 13% weight viscous petroleum and about 4% water. Fittings were attached to both ends of the tube and a conventional steam drive applied to the oil sand at a pressure of 75 psi and a temperature of 320° F. It was found during the early runs that 50% of the petroleum was recovered because of unrealistic permeability to steam, and so the runs did not successfully simulate Athabasca conditions. It was found later that by using a ½ inch-diameter solid steel rod, 12 inches long, as a tool for ramming the oil sand very tightly in the tube, the room temperature air permeabilities were reduced to less than 50 millidarcies, a much more realistic value for viscous petroleum-containing formations. In this region of permeability, conventional steam drive did not work and the steam front advanced only about 1 inch into the tube and no farther, since the initially mobilized petroleum blocked off any communication, thereby reducing the effective mobility to zero. These conditions were reproducible on a satisfactory basis.

The method of the invention was then demonstrated using the apparatus shown schematically in FIG. 3. FIG. 3 shows a partially completed demonstration in accordance with the method of the invention. The in-place tubular member 78 has been heated by opening the heating annulus control valve 90 allowing steam to pass through. This immediately provides steam injectivity at the drive end of the tar sand pack 70 and viscous petroleum produced immediately at the producing end. Recoveries in these experiments ranged from 48 to 52% weight of the total petroleum in place. Residual petroleum was determined in every case by exhaustive solvent extraction at the end of each run. In some demonstrations, too much heat was allowed to pass through the tubular member 78, thereby creating an annulus outside the tubular member of very high mobility, allowing premature steam breakthrough and giving rather poorer recoveries, on the order of only 30% of the total petroleum in place.

In order to demonstrate the present method in a laboratory under more realistic field-type conditions, the demonstrations were modified by using large chunks of relatively undistributed Athabasca oil sand. These ranged in weight from one to about four kilograms and appeared to be devoid of cracks. They were randomly shaped and generally roundish or oval. These were encased in epoxy resin so that a total thickness of about 4 inches existed all around the oil sand piece. The placement of the inplace tubular member and injector and producer were very similar to the apparatus shown in FIG. 3. Again, a ⅛ inch stainless-steel tube was used for the in-place tubular member. In order to establish that there was indeed zero effective mobility, a steam drive was always applied to the injector before allowing any heat to pass through the in-place tubular member. Three experiments were run, and in no case was there more than four drops of water produced at the exit from the block, and this slight water production ceased after less than one minute after initiating conventional steam drive. After reaching this static condition with zero injectivity, the heated annulus control valve 90 was cracked slightly, allowing passing of steam into the tubular member 78. Immediately petroleum flowed from the producer end of the core at a high petroleum/water ratio. Care must be exercised in controlling the amount of heat through the in-place tubular member since, in one case, this was not done and the over-all recovery was 30% of the total petroleum in place. Even continued flowing of steam through the block between injector and producer did not allow any further recovery of petroleum in this instance. On breaking open the block, it was found that a very clean oil sand of higher permeability had been created as an annulus close to the in-place pipe. Since the heat in the tubular member was not controlled, good sweep efficiency of the block was not obtained in this case.

The most successful demonstration run was that carried out on a 3.5-kg block of oil sand, initially 13.5% weight petroleum content. Total recovery was 65% of the petroleum originally in place. In all of these experiments, the same pressure and temperature of 75 psi and 320° F respectively were used.

Although, at first glance, the practice of the invention might lead one to expect a very low residual oil content close to the annulus surrounding the in-place tubular member and a high residual oil resulting from poor sweep efficiency in those regions of the sample farthest away from the in-place pipe, this was not the case. In fact, excellent sweep efficiency is obtained when the ratio of hot fluid to drive fluid is controlled so as not to permit early steam breakthrough. In order to evaluate this concern, the encased 3.5-kg block of oil sand at the end of a demonstration was cut through the center at right angles to the in-place tubular member. The oil sand was then cored using a ¾ inch-diameter core borer and sampled to a depth of ½ inch. This was done at 11 locations in each of 6 different planes in the oil sand block. A diagram of the location of these core samples is shown in FIG. 4. A total of 66 samples was taken and each analyzed for residual petroleum content by exhaustive extraction with toluene. The results are shown in FIG. 5. It can be seen that a remarkably uniform sweep of the oil sand sample had taken place.

Particularly surprising is the fact that the residual petroleum in those 6 cores taken from the annulus immediately surrounding the in-place tubular member show a residual petroleum content not too different from the cores farthest away from the in-place tubular member.

The demonstrations show that the method of the present invention satisfactorily simulated the zero effective mobility of the Athabasca oil sand deposit. The recovery demonstrations showed that a communication path between injector and producer can be successfully developed; and provided excessive heating of the in-place tubular member is avoided, recoveries up to 65% of the petroleum in place can be achieved. The sweep efficiency is surprisingly high, resulting in an even distribution of residual oil. This means that the reservoir after an assisted-recovery operation conducted in accordance with the invention would be amendable to further recovery techniques such as combustion, chemical floods, etc. Particularly attractive is the fact that injecting drive fluids would be confined to the area of interest between injector and producer, since this would be the only pathway open to them. In other words, it is unlikely that the fluids would be lost to the other parts of the reservoir because of the relative impermeability of the formation on the outer edge of the swept area.

What is claimed is:

1. A system for assisting the recovery of viscous petroleum from a petroleum-containing formation comprising a substantially vertical well formed through a petroleum-containing formation, said formation having an initial low potential for fluid injectivity, a casing string having a production opening near its lower portion positioned in said vertical well, a production flow line in said vertical well extending from a position adjacent said production opening to the earth's surface, packing means packing off the space between the interior of said casing string and the exterior of said production flow line above said production opening, a tubular member in said vertical well between the interior of said casing string and the exterior of said production flow line, said tubular member extending from the earth's surface to a position above said packing means to form a closed-loop flow path from the earth's surface to said packoff means and back to the earth's surface, hot fluid generating means connected to said closed-loop flow path for circulation of hot fluid therethrough to heat viscous petroleum in said formation adjacent at least a portion of said vertical well to provide a potential flow path for fluid in said formation, a second well penetrating said formation closely spaced apart from said vertical well and in communication with said potential flow path for fluid in said formation, and means for injecting a drive fluid through said second well into the upper portion of said formation into said potential flow path for fluid in said formation to promote flow of petroleum to the production opening near the lower portion of said casing string of said vertical well.

2. The system of claim 1 where the hot fluid generating means generates steam.

3. The system of claim 2 where the drive fluid is steam.

* * * * *